US006547359B2

(12) United States Patent
Fukano

(10) Patent No.: US 6,547,359 B2
(45) Date of Patent: Apr. 15, 2003

(54) PRINTER, DRIVE CONTROLLER FOR PRINT HEAD, METHOD OF CONTROLLING PRINT HEAD DRIVE, AND TEMPERATURE SENSOR

(75) Inventor: Takakazu Fukano, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 09/994,894

(22) Filed: Nov. 28, 2001

(65) Prior Publication Data

US 2002/0070992 A1 Jun. 13, 2002

(30) Foreign Application Priority Data

Nov. 29, 2000 (JP) ..... 2000-367755
Nov. 14, 2001 (JP) ..... 2001-348780

(51) Int. Cl.[7] ..... B41J 29/38; B41J 29/393
(52) U.S. Cl. ..... 347/17; 347/14; 347/19
(58) Field of Search ..... 347/17, 19, 14, 347/23, 86, 85, 12, 10, 56, 41, 42, 5

(56) References Cited

U.S. PATENT DOCUMENTS 6,293,640 B1 * 9/2001 Narushima et al. ..... 347/12
6,382,755 B1 * 5/2002 Imanaka et al. ..... 347/12
6,390,589 B1 * 5/2002 Imanaka et al. ..... 347/19

FOREIGN PATENT DOCUMENTS

JP 10-81013 3/1998

* cited by examiner

*Primary Examiner*—Lamson Nguyen
*Assistant Examiner*—Charles W. Stewart, Jr.
(74) *Attorney, Agent, or Firm*—Sughrue Mion, PLLC

(57) ABSTRACT

A print head includes rows of plural nozzles, from which ink drops are ejected. A plurality of driving elements are respectively associated with each nozzle. A plurality of switching circuits are respectively associated with each row of nozzles. Each switching circuit is provided with a plurality of switching elements, respectively associated with each driving elements. Each switching element supplies a signal to drive an associated driving element. Each of a plurality of detectors detects a condition of associated nozzles and outputting a detecting signal in accordance with the detected condition. A controller drives the print head based on the detecting signals. At least one signal line transmits the detecting signals to the controller in a time sequence manner. The number of the signal line is less than the number of the detectors.

20 Claims, 16 Drawing Sheets

BOTTOM

| SI | H | L | SP | | | | | | | | | | |
|---|---|---|---|---|---|---|---|---|---|---|---|---|---|
| | 0 | 0 | 0 | 0 | 0 | 0 | 0 | 0 | 0 | 0 | 0 | 0 | 0 |
| | 0 | 1 | 0 | 1 | 0 | 0 | 0 | 0 | 0 | 0 | 0 | 0 | 0 |
| | 1 | 0 | 1 | 0 | 1 | 0 | 0 | 0 | 0 | 0 | 0 | 0 | 0 |
| | 1 | 1 | 1 | 1 | 1 | 0 | 0 | 0 | 0 | 0 | 0 | 0 | 0 |

TOP

PRINTER, DRIVE CONTROLLER FOR PRINT HEAD, METHOD OF CONTROLLING PRINT HEAD DRIVE, AND TEMPERATURE SENSOR

BACKGROUND OF THE INVENTION

The present invention relates to a technique of detecting information about each of a plurality of rows of nozzles provided in a print head unit of a printer; for example, to a technique of sensing information about the temperature of a transmission gate (hereinafter called a "TG"), which is provided in a head drive circuit mounted in a head unit and constituted of a switching circuit for supplying a drive signal to drive elements provided so as to correspond to nozzles for ejecting ink droplets, and sending the temperature information to a control section of a printer main unit.

A color printer which ejects ink of several colors from a recording head has hitherto found widespread use as an output device of a computer. The color printer is widely used for printing an image processed by a computer in multiple gradations of plural colors.

For instance, an ink jet printer ejects ink droplets from a plurality of nozzles of the print head, by actuating piezoelectric elements, which are provided so as to be associated with the respective nozzles, thereby performs printing operation.

The piezoelectric elements that eject ink droplets from the nozzles are actuated by a drive signal supplied from a driver IC (head drive circuit) provided in the print head. The driver IC (head drive circuit) is configured so as to include a TG constituted of a switching circuit for supplying a drive signal to only piezoelectric elements corresponding to nozzles which are to eject ink.

At the time of printing operation, the TG is repeatedly activated or deactivated in accordance with ink ejection timings. The temperature of the TG (based on primarily a junction temperature Tj of a semiconductor used in the TG) increases in accordance with power consumed by the TG. The power consumed by the TG becomes greater on the basis of the magnitudes of activation/deactivation frequencies of the switch; that is, a print speed. Accordingly, if a print speed is increased, the temperature of the TG tends to increase.

The temperature of the TG cannot be set to a value which is greater than a threshold value of the junction temperature Tj (i.e., an allowable temperature) of the semiconductor device used in the TG. For this reason, a temperature margin of the TG becomes smaller with an increase in print speed.

When ink is ejected from the nozzles, the ink serves as a cooler so that an increase in the temperature of the TG can be suppressed. However, in the event that ink has become depleted during a printing operation, the cooling cannot be performed. For this reason, a rise in the temperature of the TG becomes considerable. If the temperature margin of the TG becomes narrow, there will arise a case where the temperature of the TG exceeds the foregoing allowable temperature for reasons of a temperature rise stemming from depletion of ink. In other words, when the-head is filled with ink and ejects ink normally, no temperature error arises. There is a necessity for sensing a rise in the temperature of the TG which would arise at the time of occurrence of an operation failure such as an idle ejecting operation.

To this end, a temperature detection circuit which produces an analog signal corresponding to the temperature of a TG is provided in an IC chip including a TG provided for each row of nozzles in a print head. By way of corresponding signal lines provided in a flexible flat cable (hereinafter called an "FFC"), the temperature detection circuits send analog signals corresponding to the thus-detected temperatures of the respective TGs to an A/D converter provided in a controller on a main board within a printer main unit. On the basis of digital outputs from the A/D converter, the temperatures of respective TGs are determined, and the head drive circuit is controlled in accordance with the thus-determined temperatures.

When a plurality of rows of nozzles and, by extension, a plurality of TGs (or IC chips including the TGs) are provided on a head in the manner as mentioned in connection with the case of the foregoing configuration, the FFC must have a plurality of signal lines assigned to the TGs for sensing the temperatures thereof. Consequently, the width of the FFC also increases, thus posing difficulty in the wiring work. Moreover, a signal line for temperature detection is provided for each TG. If the number of TGs is large, a corresponding rise in costs inevitably arises.

SUMMARY OF THE INVENTION

It is therefore an object of the present invention to provide a printer which is comparatively inexpensive and can facilitate the wiring work of an FFC, by using only one signal line for detecting temperatures of TGs.

In order to achieve the above object, according to the present invention, there is provided A printing apparatus, comprising:

- a print head, including:
  - rows of plural nozzles, from which ink drops are ejected;
  - a plurality of driving elements, respectively associated with each nozzle;
  - a plurality of switching circuits, respectively associated with each row of nozzles, each switching circuit provided with a plurality of switching elements, respectively associated with each driving elements, each switching element supplies a signal to drive an associated driving element; and
  - a plurality of detectors, each detecting a condition of associated nozzles and outputting a detecting signal in accordance with the detected condition;
- a controller, which drives the print head based on the detecting signals;
- at least one signal line, which transmits the detecting signals to the controller in a time sequence manner,
- wherein the number of the signal line is less than the number of the detectors.

Preferably, each detector detects temperature condition of an associated switching circuit as the detected condition. The detecting signals are transmitted via a single signal line. The controller determines temperature of each switching circuit to drive the print head-based on the determined temperatures.

Here, it is preferable that each detector is provided as a temperature sensor operated in accordance with temperature dependency of a potential difference appearing between a PN junction of a semiconductor.

Further, it is preferable that a temperature of a nozzle situated in a substantially center of each nozzle row is detected representatively as the temperature condition.

Still further, it is preferable that the detecting signals are selectively picked up and transmitted through the single signal line.

In this configuration, preferably, output sides of the respective detectors are commonly connected by an analog switch, through which the detecting signals are selectively picked up.

Alternatively, it is preferable that output sides of the respective detectors are commonly connected by an operational amplifier, through which the detecting signals are selectively picked up, when the operational amplifier is activated.

Further, it is preferable that the detecting signals are picked up every time at least one of when a single page printing is performed and when a cleaning operation for the print head is performed.

Alternatively, it is preferable that the detecting signals are picked up when a high-duty printing is continued for a predetermined time period.

Still further, it is preferable that the selective pickup of the detecting signals is performed based on a signal contained in print data sent to the switching circuits.

Here, it is preferable that information on a least significant digit of the print data is used as the signal to perform the selective pickup of the detecting signals.

Alternatively, it is preferable that the selective pickup of the detecting signals is performed based on a signal contained in program data sent to the switching circuits.

Preferably, the controller is provided with at least one analog/digital converter, each connected with an associated signal line so that the controller detects the detecting signal as a digital signal.

Here, it is preferable that the controller is provided with a print controller of the printing apparatus.

Preferably, each nozzle row is associated with a single color to be printed.

According to the present invention, by means of a simple method any one can be selected from analog signals output from the plurality of temperature sensors. Therefore, only one common signal line to be used for selectively extracting an analog signal output from any one of the temperature sensors is provided in the FFC or the like that connects a recording head to a control section, thus facilitating the wiring work of the FFC.

Accordining to the present invention, there is also provided a print controller of a print head, which includes:

at least two rows of plural nozzles, from which ink drops are ejected;

a plurality of driving elements, respectively associated with each nozzle; and at least two switching circuits, respectively associated with each row of nozzles, each switching circuit provided with a plurality of switching elements, respectively associated with each driving elements, each switching element supplies a signal to drive an associated driving element, the print controller comprising:

at least two temperature detectors, each detecting temperature condition of an associated switching circuit and outputting a detecting signal in accordance with the detected temperature condition; and a controller, which determines temperature of each switching circuit based on the detecting signals transmitted via a single signal line in a time sequence manner to drive the print head based on the determined temperatures.

Accordining to the present invention, there is also provided a temperature detector for a printing apparatus, which includes:

at least two rows of plural nozzles, from which ink drops are ejected;

a plurality of driving elements, respectively associated with each nozzle; and at least two switching circuits, respectively associated with each row of nozzles, each switching circuit provided with a plurality of switching elements, respectively associated with each driving elements, each switching element supplies a signal to drive an associated driving element; and a controller, which drives the print head, the temperature detector comprising:

at least two temperature detectors, each detecting temperature condition of an associated switching circuit and outputting a detecting signal in accordance with the detected temperature condition;

a single signal line for transmitting the detecting signal to the controller in a time sequence manner; and a temperature determinant provided with the controller, which determines temperature of each switching circuit based on the detecting signals to drive the print head based on the determined temperatures.

Accordining to the present invention, there is also provided a method of driving a print head which includes:

at least two rows of plural nozzles, from which ink drops are ejected;

a plurality of driving elements, respectively associated with each nozzle;

at least two switching circuits, respectively associated with each row of nozzles, each switching circuit provided with a plurality of switching elements, respectively associated with each driving elements, each switching element supplies a signal to drive an associated driving element; and at least two temperature detectors, each detecting temperature condition of an associated switching circuit and outputting a detecting signal in accordance with the detected temperature condition, the method comprising the steps of:

selecting one of the detecting signals outputted from the respective temperature detectors;

picking up the selected detecting signal via a single signal line;

determining temperature of an associated switching circuit based on the selected detecting signal; and driving the print head based on the determined temperature.

Preferably, the selecting step and are repeated so that the detecting signals are picked up via the single signal line in a time sequence manner.

DETAILED DESCRIPTIONS OF PREFERRED EMBODIMENTS

Figure 1:
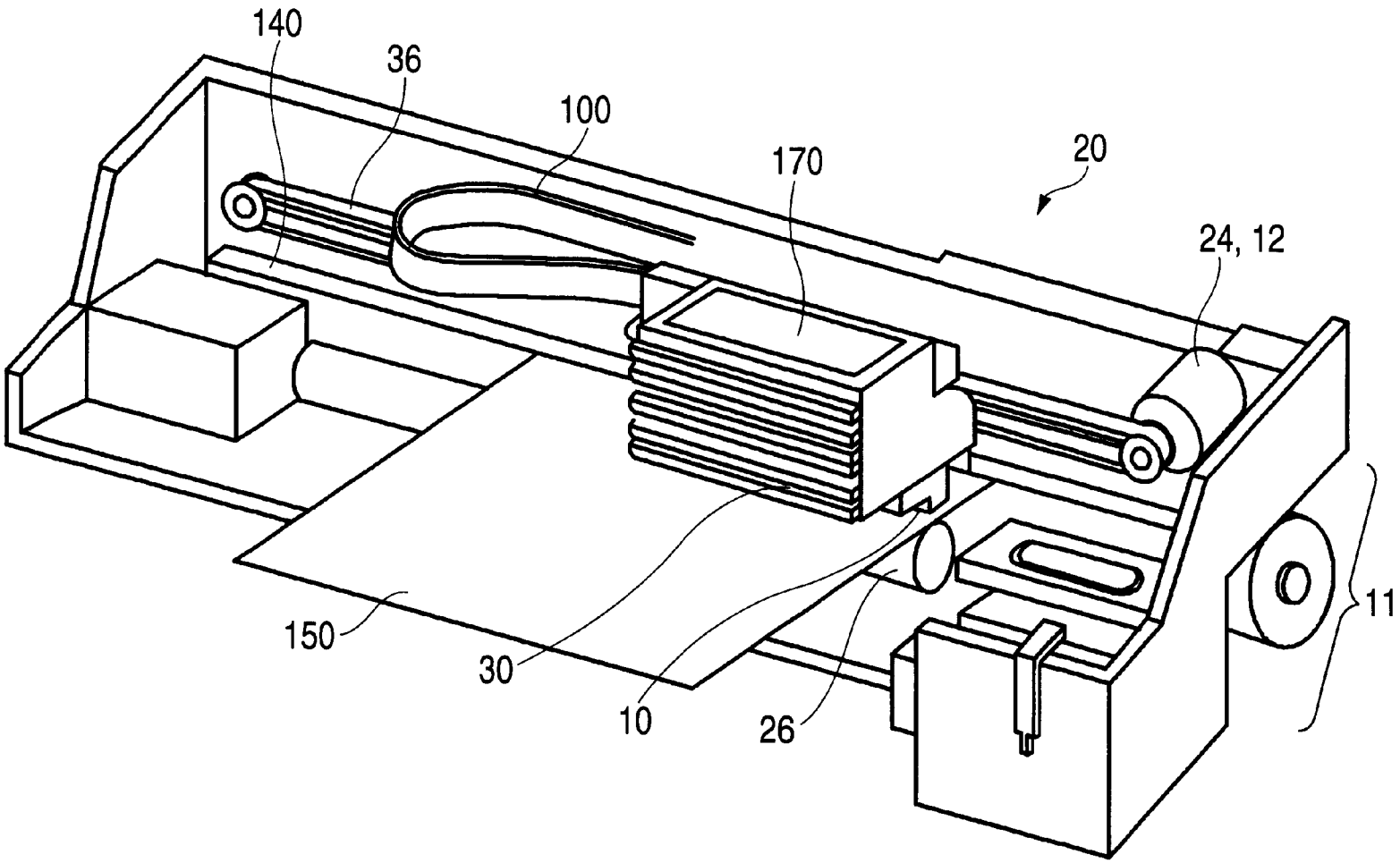
FIG. 1 is a perspective view showing a principal section of an ink jet printer serving as a printer according to embodiments of the present invention.

Printers according to embodiments of the invention will be described by reference to the drawings. FIG. 1 is a perspective view showing the principal section of an ink jet printer 20 which is a printer according to a first embodiment of the invention. Here, the ink jet printer 20 can eject ink of seven colors; that is, cyan (C) ink, light cyan (LC) ink, magenta (M) ink, light magenta (LM) ink, yellow (Y) ink, dark yellow (DY) ink, and black (K) ink.

As shown in FIG. 1, a carriage 30 is connected to a carriage motor 24 of a carriage mechanism 12 by way of a timing belt 36 in the ink jet printer 20. The carriage 30 is guided by a guide member 140, to thereby travel back and forth across print paper 150. Further, a paper feeding mechanism 11 using a paper feeding roller 26 is formed also in the ink jet printer 20. A print head 10 of ink jet type is provided on a face of the carriage 30 that opposes the print paper 150; that is, a lower face of the carriage 30 in the illustrated example. The print head 10 is replenished with ink from an ink cartridge 170 mounted on top of the carriage 30 (the cartridge includes cartridges of seven colors) and ejects ink droplets of respective colors onto the print paper 150 in synchronism with movement of the carriage 30, thus forming dots and printing an image or character on the print paper 150.

Figure 2:
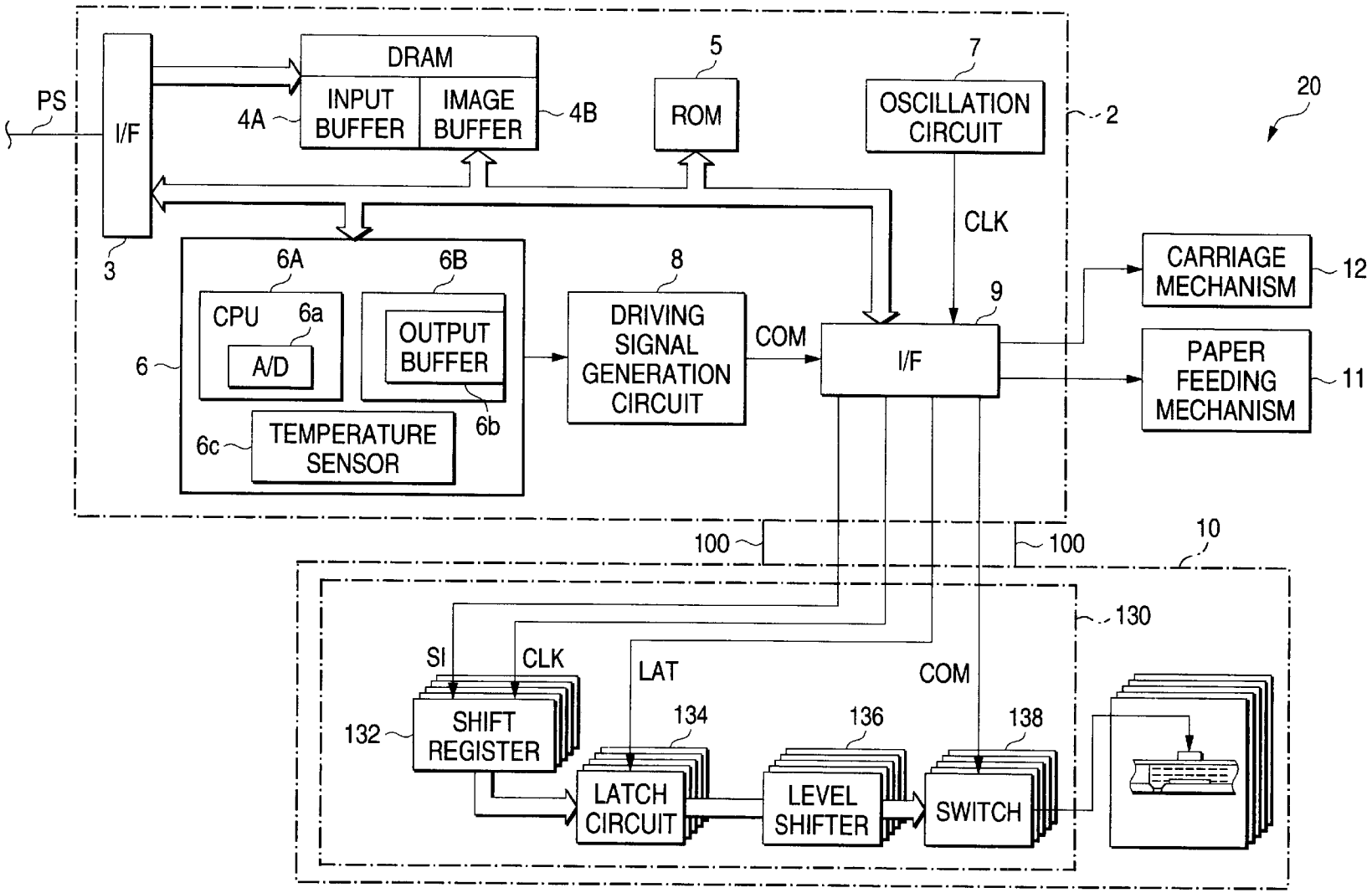
FIG. 2 is a functional block diagram showing the overall configuration of the ink jet printer.

FIG. 2 is a functional block diagram of the ink jet printer 20 according to the present embodiment. As shown in FIG. 2, the ink jet printer 20 comprises a main unit 2, a carriage mechanism 12, a paper feeding mechanism 11, and a print head 10. As described by reference to FIG. 1, the paper feeding mechanism 11 is constituted of a paper feeding motor (not shown) and the paper feeding roller 26. The paper feeding mechanism 11 performs a subscanning operation for sequentially feeding a recording medium such as the print paper 150. The carriage mechanism 12 comprises a carriage 30 having the print head 10 installed therein, and the carriage motor 24 for causing the carriage 30 to travel via the timing belt 36. The carriage mechanism 12 causes the print head 10 to perform a main scanning operation.

The main unit 2 comprises an interface 3 for receiving from a host computer (not shown) a print signal PS including multilevel hierarchical information; an input buffer 4A and an image buffer 4B, which are constituted of DRAM (Dynamic Random Access Memory) for storing various types of data such as print data including multilevel hierarchical information; ROM 5 holding routines for effecting various types of data processing operations; a control section 6 constituted of a CPU 6A and a head control unit (module) 6B provided in an ASIC (Application-Specific Integrated Circuit); an oscillation circuit 7; a drive signal generation circuit 8 which produces a drive signal COM to be sent to the print head 10; and an interface 9 having the function of transmitting to the print head 10 print data Si that have been converted into print image data. An output buffer 6*b* constituted of SRAM (Static Random Access Memory) is provided on the head control unit (module) 6B.

The print head 10 is connected to the main unit 2 by way of an FFC 100. As shown in FIG. 1, a long FFC is used as the FFC 100 for avoiding hindrance to movement of the carriage 30.

As will be described later, besides possessing the CPU 6A and the head control unit (module) 6B, the control section 6 has a temperature sensor 6C for sensing the internal temperature of each of IC chips (TGs) provided for seven rows of color nozzles of the print head 10. As will be described later, the CPU 6A provided in the control section 6 has an A/D converter 6*a* which converts, into a digital signal, an analog signal output from an internal temperature sensor of each IC chip via one of signal lines provided in the FFC 100.

Figure 3:
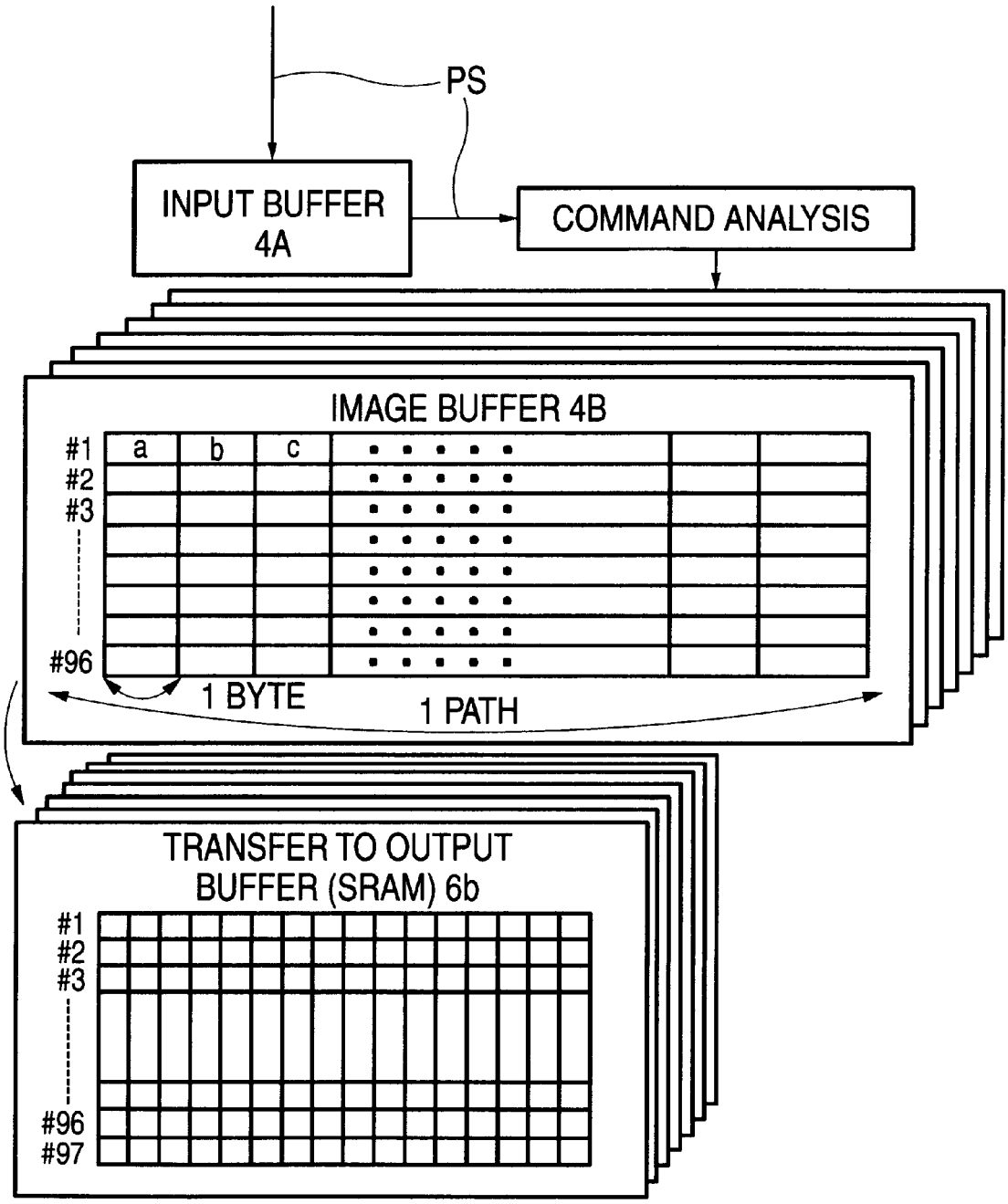
FIG. 3 is an illustration showing that data conversions at an image buffer and an output buffer on a head control unit of the ink jet printer shown in FIG. 2.

In the ink jet printer 20 having the foregoing configuration, as shown in FIG. 3, the print signal PS, which has been delivered from the host computer and includes multilevel hierarchical information, is retained in the input buffer 4A provided in the printer main body via the interface 3. The print signal PS retained in the input buffer 4A is subjected to command analysis. The print signal is then subjected to the processing performed by the control section 6; that is, processing in which a printed position, a size, a type of modification, a font address or the like of each character is added. The control section 6 converts and stores the thus-analyzed data into the image buffer 4B on the DRAM as print image data. The image buffer 4B is constituted so as to correspond to the structure of a head. For instance, as in the case of the present embodiment, seven rows of nozzles are formed in the print head 10 in a seven-color printer having 96 nozzles per row. Hence, the image buffer 4B is constituted so as to correspond to seven colors. For instance, data corresponding to one path of cyan (C) nozzle #1 are transferred in a rasterizing direction (in the sequence of "a," "b," and "c"). After transfer of data pertaining to nozzle #1 has been completed, similar processing is iterated, to thereby transfer data pertaining to nozzles #2, #3, . . . #96. Similar operations for converting and transferring data are performed for the remaining six colors.

When the image buffer 4B has become full, the image buffer 4B transfers data pertaining to one word (corresponding to rows "a" and "b" of the image buffer 4B) to the output buffer 6B which is provided in the head control unit (module) 6B and consists of SRAM. Subsequently, the zeroth bit of the word is subjected to raster-row conversion from #1 to #96. The thus-converted data are serially transferred to a head drive circuit 130. These operations are iterated 16 times, thereby completing transfer of the data corresponding to one word. A similar transfer operation is performed for the remaining six colors. Subsequently, an interrupt is performed, thereby processing the next word. These operations are iterated. As will be described later, in the present embodiment, data #97 to be used for selecting temperature sensor outputs from the TGs 138*a* through 138*g* are added to an output buffer 4C on the head control unit (module).

Figure 4:
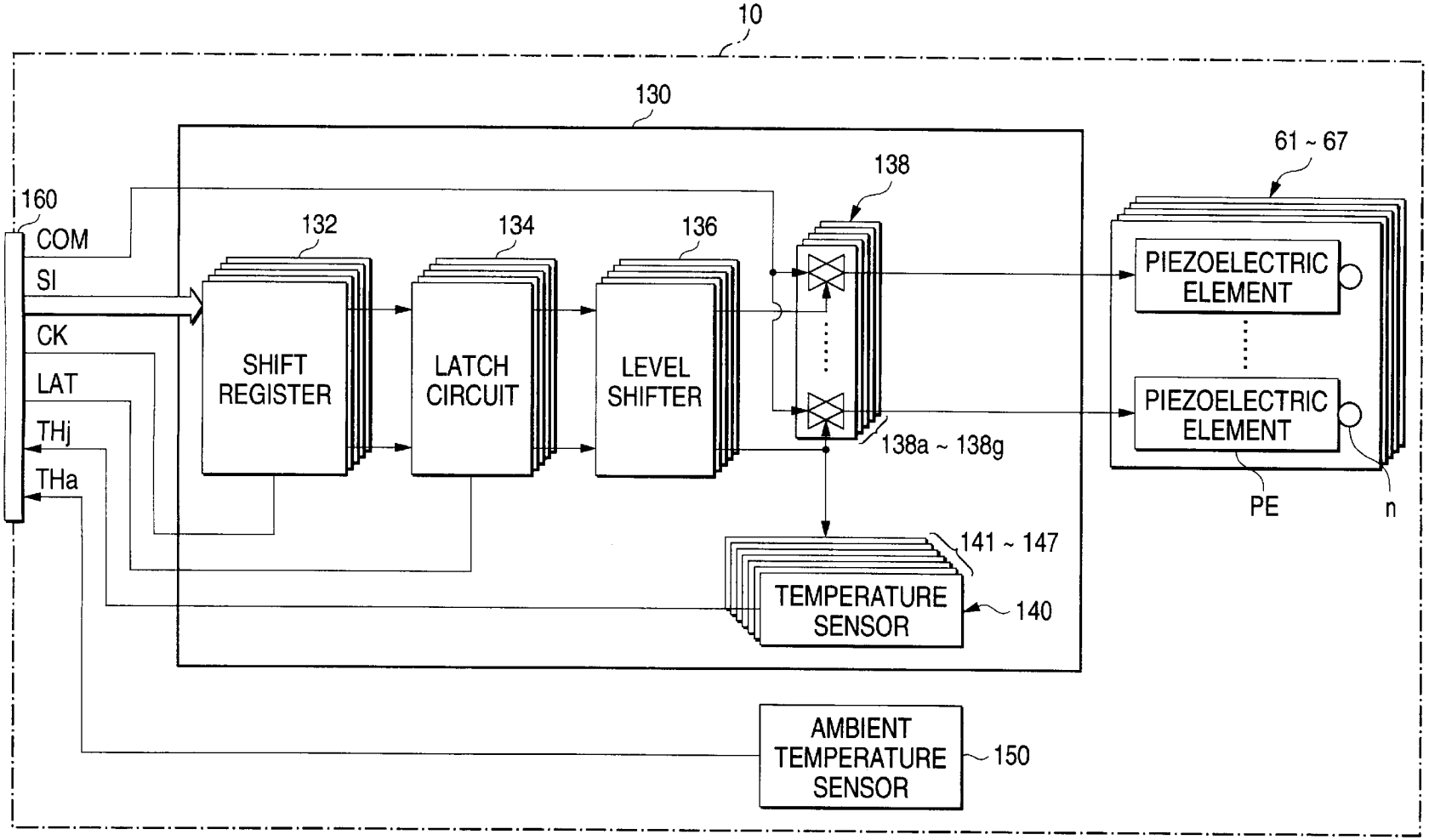
FIG. 4 is a block diagram showing the functional configuration of a print head.

FIG. 4 is a block diagram showing the functional configuration of the print head 10. As shown in FIG. 4, the print head 10 comprises the head drive circuit 130, rows of nozzles 61 through 67 for ejecting ink of seven colors, and an ambient temperature sensor 150. The head drive circuit 130 is supplied, by way of the connector 160, with a drive signal COM generated by the drive signal generation circuit 8; print data SI supplied from the output buffer 4C on the head control unit (module) provided in an ASIC; a clock signal CK; and a latch signal LAT. The print data SI corresponds to print image data which is converted, through the image buffer 4B and the output buffer 4C, from the print data contained in the print signal PS from a host computer (not shown). The print data SI are transferred for row of nozzles of each color; that is, for each TG (e.g., SI1 to SI7, and for convenience of explanation print data SI1 to be transferred to a TG 138*a* will often be described as print data SI).

The head drive circuit 130 is an integrated circuit constituted of a shift register 132, a latch circuit 134, a level shifter 136, and a TG 138. Further, the head drive circuit 130 is provided with a temperature sensor 140 for detecting a temperature of the TG 138. The shift register 132, the latch circuit 134, the level shifter 136, the TG 138, and the temperature sensor 140 are provided for each of the seven rows of nozzles provided in the print head 10.

When the print image data corresponding to one scanning action of the print head 10 have been obtained, the print image data are serially transferred to the print head 10 via the interface 9 as print data SI. In synchronism with the clock signal (CLK) output from the oscillation circuit 7, the print data SI are serially transferred to and set in the shift register 132 from the interface 9. In this case, the most significant bit data in the print data SI pertaining to each nozzle are serially transferred, and the second significant bit data are serially transferred. Similarly, lower bits of data are serially transferred. The thus-serially-transferred print data SI are temporarily latched by the latch circuit 134. The latched print data SI is boosted to a predetermined voltage; e.g., to tens of volts, which can actuate an analog switch 138*a* of the TG 138, by the level shifter 136 serving as a voltage amplifier. The print data SI that have been boosted to the predetermined voltage are delivered to the analog switch 138*a*. A drive signal (COM) output from the drive signal generation circuit 6B provided in the control section 6 is applied to an input side of the analog switch 138*a*. Further, a piezoelectric element PE serving as a drive element for ejecting ink droplets is connected to an output side of the analog switch 138*a*. The analog switch 138*a* of the TG 138 is activated or deactivated in accordance with the print data SI. For instance, during a period in which the print data applied to the analog switch 138*a* assume a value of "1," the drive signal COM is applied to the piezoelectric element PE. The piezoelectric element PE causes expansion and contraction in accordance with the drive signal. Consequently, ink in a pressure generating chamber is pressurized to be ejected from nozzle orifices. During a period in which the print data applied to the analog switch 138*a* assume a value of "0," supply of the drive signal COM to the piezoelectric element PE is interrupted, and hence ink droplets are not ejected.

Figure 5:
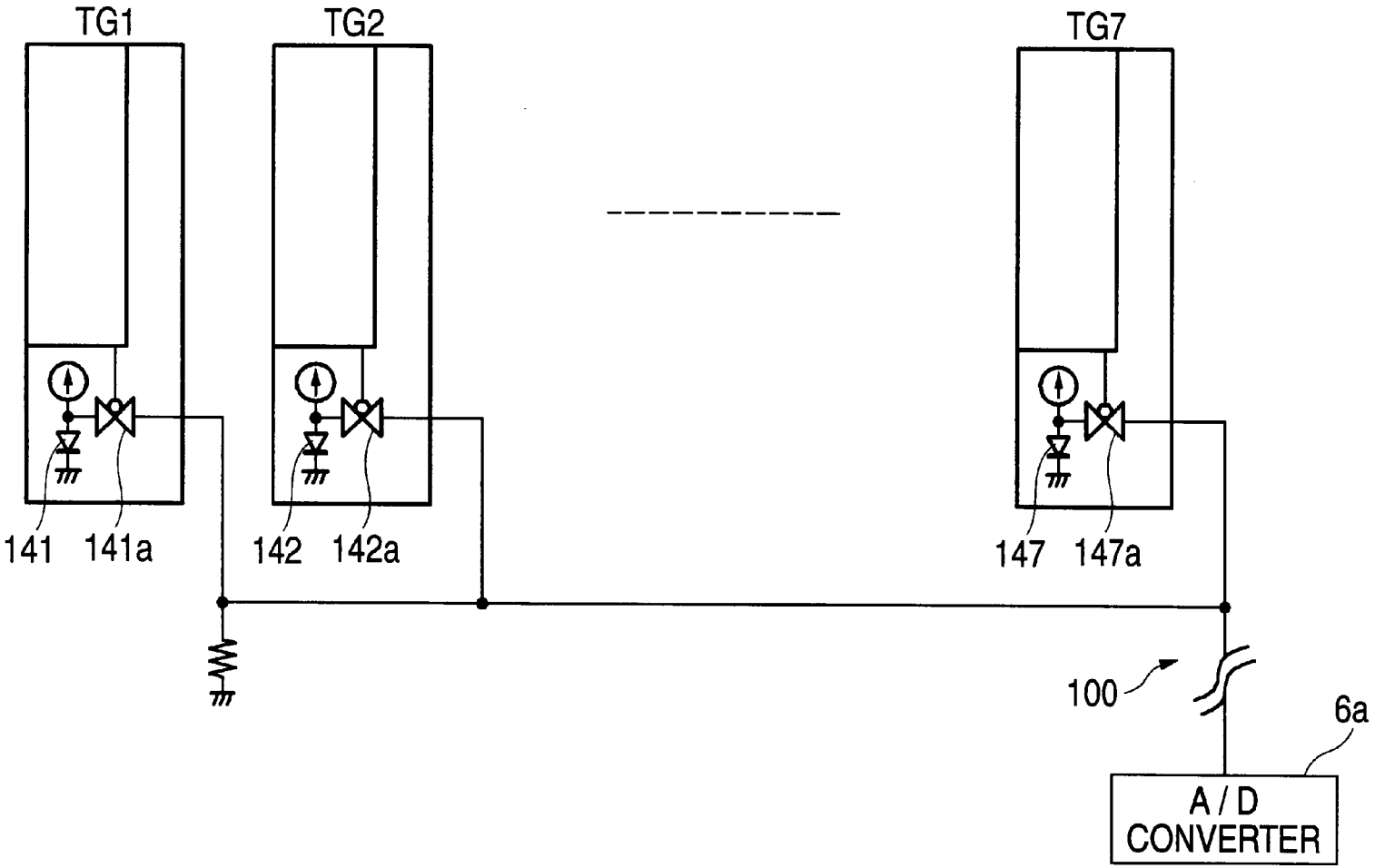
FIG. 5 is an illustration showing an example in which, according to a first embodiment, analog signals output from respective temperature sensors are connected together commonly outside IC chips including TGs by way of analog switches, and input to an A/D converter provided in a CPU of a control section by way of an FFC.

As shown in FIG. 4, in the present embodiment, temperature sensors 141 through 147 are provided for respective TGs 138*a* through 138*g*. As shown in FIG. 5, output sides of the temperature sensors 141 through 147 are connected to a common line outside of IC chips including the respective TGs 138*a* through 138*g*. Analog signals output from the temperature sensors 141 through 147 are input, via the FFC 100, to the A/D converter 6*a* provided in the CPU 6A of the control section 6.

Figure 6:
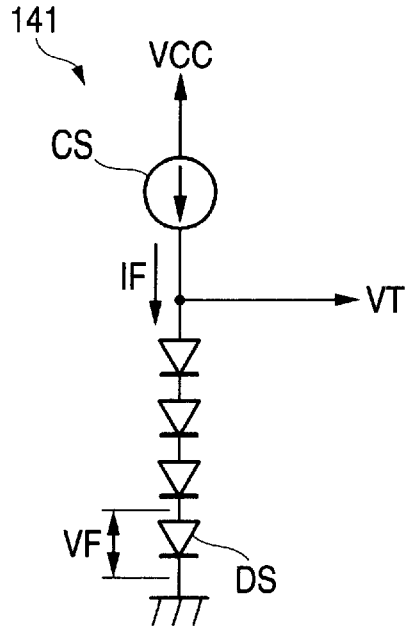
FIG. 6 is a schematic illustration showing a temperature sensor according to the first embodiment.

FIG. 6 is a schematic diagram relating to the temperature sensors 141 through 147, showing only one of the temperature sensors (i.e., the temperature sensor 141). As shown in FIG. 6, the temperature sensor 141 is constituted of four diodes DS connected in series, and a constant current source CS for supplying a forward current to the four diodes DS. A potential difference VT developing between the four diodes DS is output as a signal THj1 from the temperature sensor 141.

Figure 7:
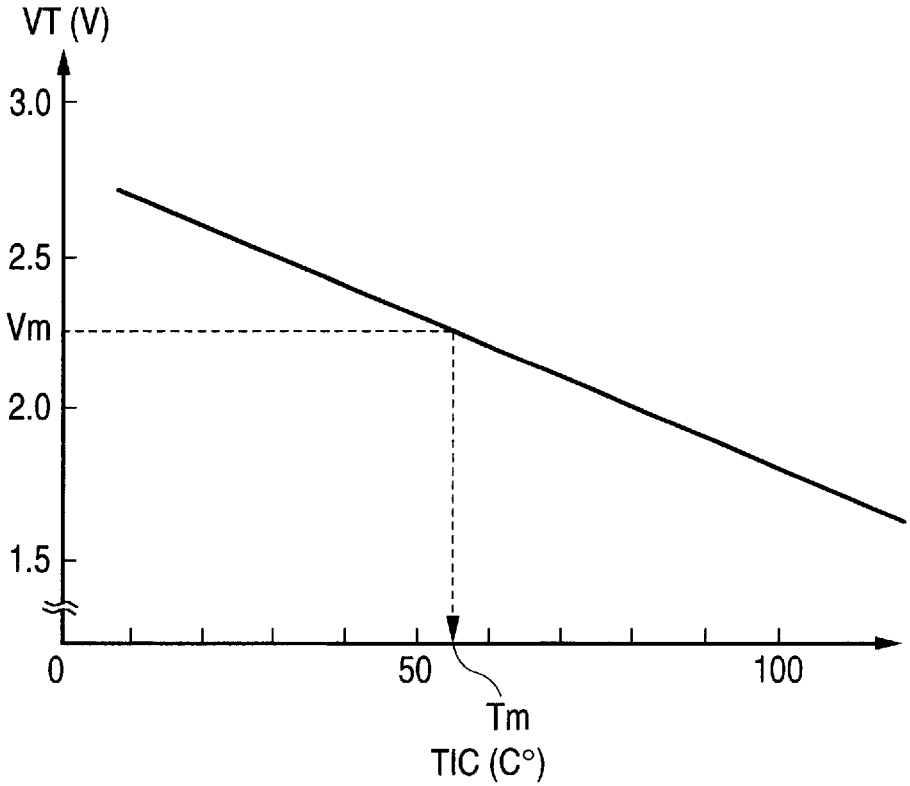
FIG. 7 is a graph showing an example of correlation between a voltage output from the temperature sensor shown in FIG. 6 and the temperature of a TG.

FIG. 7 is a graph showing an example of the relationship between the temperature of the TG 138*a* and the output VT from the temperature sensor 141. The output VT from the temperature sensor 141 is equal to the sum of forward voltages VF of the four diodes DS. A voltage across the anode and cathode of the diode DS; that is, the forward voltage VF developing in a PN junction, changes in accordance with a junction temperature Tj and has a characteristic of a substantially constant gradient. Accordingly, the output VT from the temperature sensor 141 changes in accordance with a change in the temperature of the forward voltage VF of the diode DS. As mentioned above, the temperature sensor 141 utilizes a temperature dependency of the forward voltage VF of the diode DS. In the temperature sensor 141, four diodes DS are connected in series. This is intended to improve an accuracy of detection, by increasing a rate of change in the output VT (a rate of change in output to a temperature change). Accordingly, the temperature sensor 141 is not necessarily limited to the configuration in which the four diodes DS are connected in series. For instance, the temperature sensor 141 may be constituted of one diode DS. Alternatively, the temperature sensor 141 may be constituted by connecting two or three diodes DS in series or five or more diodes DS in series. Moreover, the temperature 141 may utilize, in place of a diode, a potential difference arising in the base and emitter of a bipolar transistor. In short, any temperature sensor may be employed, so long as the sensor utilizes the temperature dependency of a potential difference arising between a PN junction of a semiconductor device.

Figure 8:
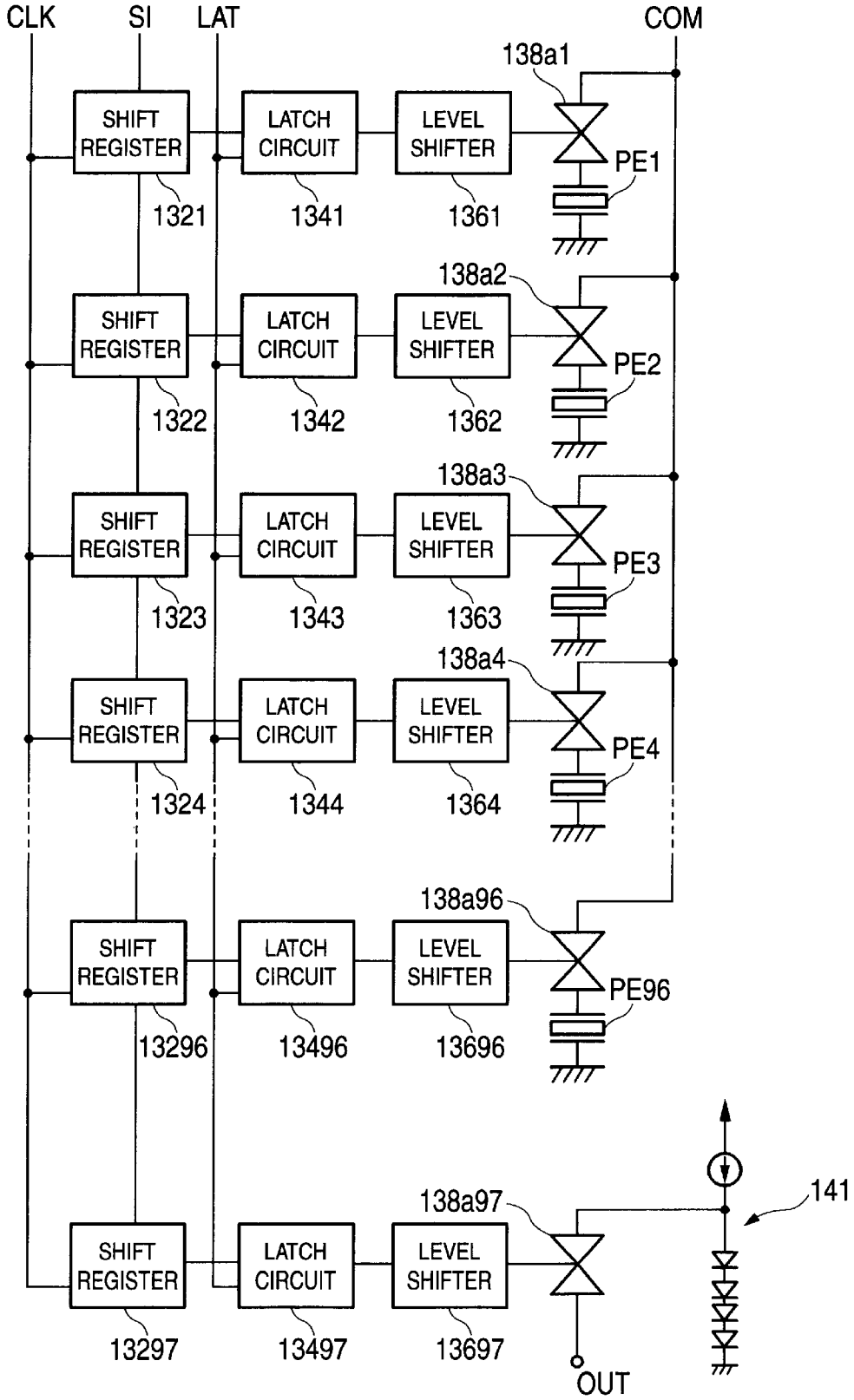
FIG. 8 is an illustration showing the configuration of a head drive circuit according to the first embodiment.
Figure 9:
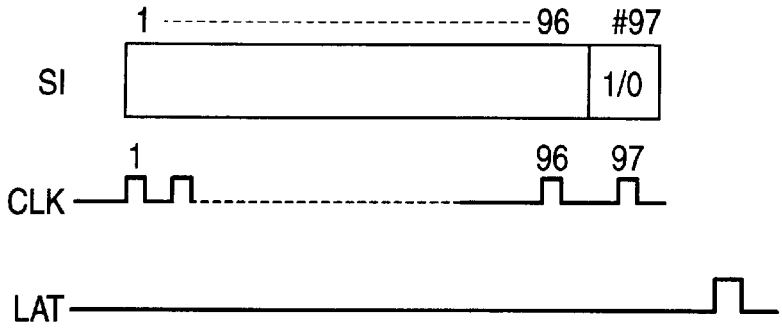
FIG. 9 is a timing chart showing print data, a clock signal, and a latch signal, which are supplied to a shift register in the head drive circuit and to a latch circuit when a final bit of print data (97 bits) is used as identifying information to be used for selectively detecting a signal output from a temperature sensor of a TG of interest.

In relation to the present embodiment, by reference to FIGS. 8 and 9 there will be described a method of detecting the temperatures of the respective TGs 138*a* through 138*g* through use of the temperature sensors 141 through 147. In the present embodiment, one is selected from temperature detection outputs relating to the TGs 138*a* through 138*g* by use of a print data (SI) line. In other words, a signal "0" or "1" to be used for selecting one from the temperature detection outputs relating to the TGs 138*a* through 138*g* is added to, as #97 data, the print data SI supplied from the output buffer 4C on the head control unit (module) in the foregoing ASIC. FIG. 8 is a block diagram showing the configuration of the head drive circuit 130 employed in the embodiment. FIG. 9 is a timing chart showing the print data SI, the clock signal CLK, and the latch signal LAT, which are to be supplied to the shift register 132 and the latch circuit 134 in the head drive circuit 130.

As shown in FIG. 8, 96 nozzles are provided for each color (i.e., piezoelectric elements PE1 through PE96). Shift registers 1321 through 13296, latches 1341 through 13496, level shifters 1361 through 13696, and bi-directional analog switches 138*a*1 through 138*a*96 are provided so as to correspond to the respective ninety-six nozzles. In the present embodiment, there are also provided a shift register 13297, a latch 13497 connected to the shift register 13297, and a level shifter 13697 connected to the latch 13497. The level shifter 13697 is connected to the bi-directional analog switches 138*a*1 through 138*a*96. The temperature sensor 141 is connected to one end of an analog switch 138*a*97, and the other end of the analog switch 138*a*97 is connected to an output terminal. Here, FIG. 10A shows the configuration of the bi-directional analog switches 138*a*1 through 138*a*96; and FIG. 10B shows the configuration of the bi-directional analog switch 138*a*97.

Figure 10A:
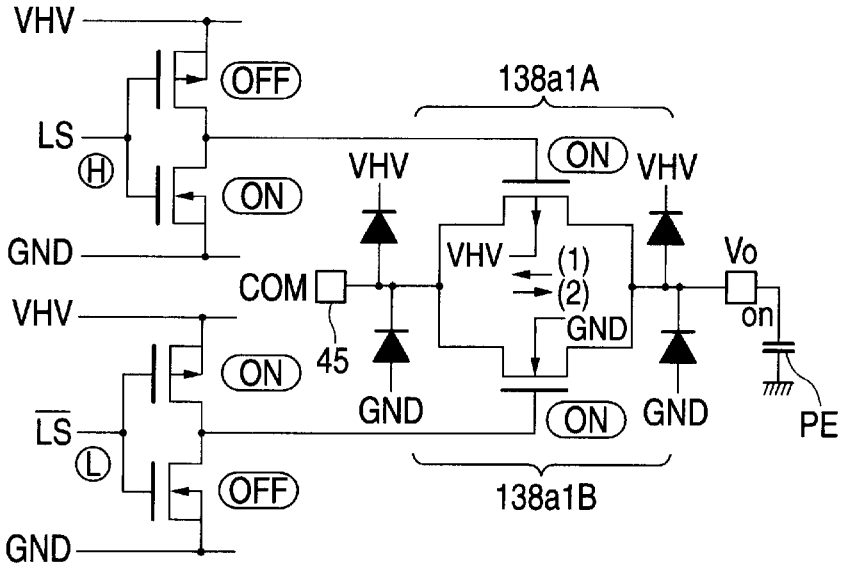
FIG. 10A is a diagram showing the configuration of a bi-directional analog switch for ejecting ink droplets.
Figure 10B:
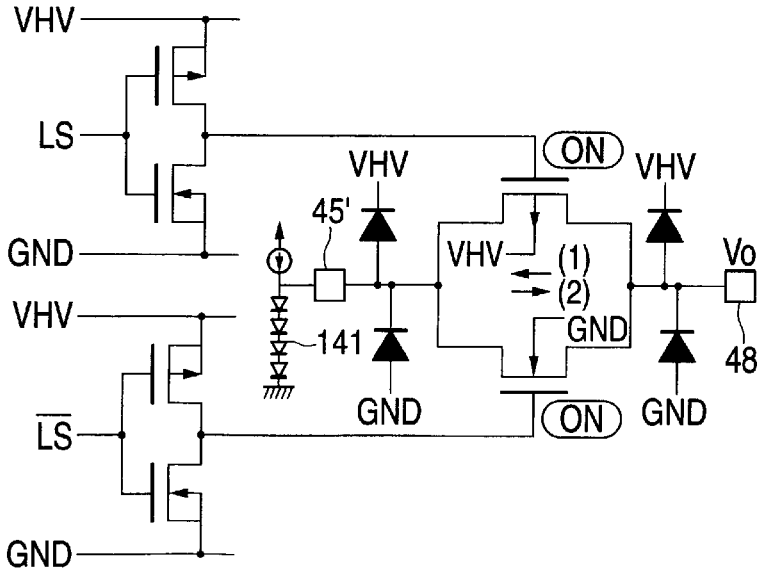
FIG. 10B is a diagram showing the configuration of a bi-directional analog switch for detecting a temperature.

As shown in FIG. 10A, when a positive output LS of the level shifter is high, and a reverse output $\overline{LS}$ of the level shifter is low, both of analog switches 138*a*1A and 138*a*1B are turned on. Accordingly, a discharge current (1) and a charge current (2) flow in both directions on the basis of the drive signal COM and a potential Vo. In contrast, when the positive output LS of the level shifter is low and the reverse output $\overline{LS}$ of the level shifter is high, both of the analog switches 138*a*1A and 138*a*1B are turned off. As a result, a state of high impedance is maintained. In each of the analog switches 138*a*1A and 138*a*1B, a back gate terminal is connected to VHV and GND lines. The drive signal COM is input from a COM input terminal 45. As shown in FIG. 10B, an input terminal 45' of the bi-directional analog switch 138*a*97 is connected to a temperature sensor 141, and the other terminal of the analog switch 138*a*97 is connected to an output terminal 48.

As shown in FIG. 9, the print data SI are additionally provided with a signal "1" or "0" as #97 data for selecting one from the temperature detection outputs from the TGs 138*a* through 138*g*. When a temperature detection output from the TG 138*a* is selected, the print data SI including "1" are input as #97 data to the shift register 13297 in synchronism with the 97th clock signal CLK. The latch signal LAT is input to the latch 13497 at the timing shown in FIG. 9. Hence, the signal is boosted to a predetermined voltage which enables activation of the analog switch 138*a*97 by way of the level shifter 13697; for example, about tens of volts. The #97 data set of the print data SI is applied to the analog switch 138*a*97, whereby the analog switch 138*a*97 is brought into a connected state. An output from the temperature sensor 141 is applied to the analog switch 138*a*97. When the analog switch 138*a*97 is brought into a connected state, the output terminal 48 of the analog switch 138*a*97 outputs an analog signal corresponding to the temperature of the TG138*a* detected by the temperature sensor 141.

At the same timing as that mentioned above, a signal "0" is added, as the 97# data, to the print data SI of another color (the print data SI supplied to another nozzle). Accordingly, at this timing only an analog signal output from a temperature sensor 141 which detects a temperature of the TG138*a* can be selectively extracted.

As mentioned above, a signal "1" or "0" to be used for selecting one from the temperature detection outputs of the TGs 138*a* through 138*g* is added, as the #97 data, to the print data SI, thereby enabling selection of any one whose temperature is to be detected from among the TGs 138*a* through 138*g*. Even when the temperature sensors 141 through 147 are provided for the respective TGs 138*a* through 138*g* and output terminals of the temperature sensors 141 through 147 are connected to a single line outside IC chips including the respective TGs, by way of the analog switches 141*a* through 147*a*, an analog output signal can be selectively extracted from the analog signals output from the temperature sensors 141 through 147 by a simple method. Accordingly, only one common signal line is provided in the FFC 100 for selectively extracting one from the analog signals output from the temperature sensors 141 through 147.

Figure 11:
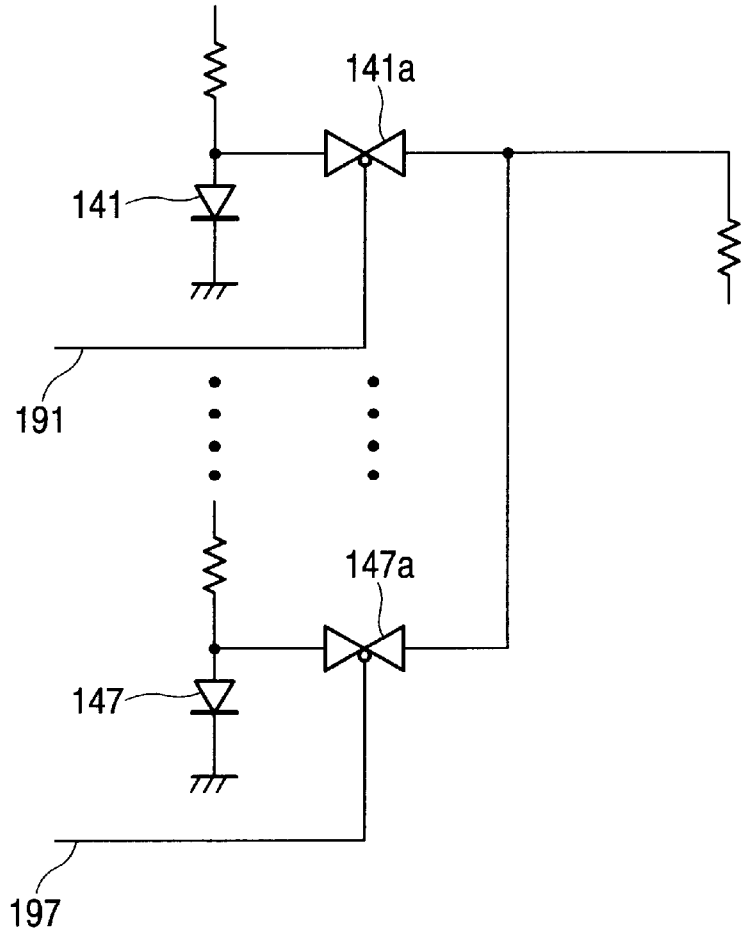
FIG. 11 is a diagram showing a configuration in which output sides of the temperature sensors are connected commonly together outside the IC chips including the TGs by way of analog switches, and in which a signal to be used for selectively activating the analog switches is input through use of control lines.

As shown in FIG. 11, there may also be conceived a configuration in which the output terminals of the temperature sensors 141 through 147 are connected to a common line outside the IC chips including the respective TGs by way of the analog switches 141*a* through 147*a* and a signal for selectively activating the analog switches 141*a* through 147*a* is input to the common line. This case involves a necessity for use of the control lines 191 through 197 for inputting a signal to be used for selectively activating the analog switches. In contrast, the present embodiment obviates such a necessity for the control lines and enables selection of any one from the analog signals output from the temperature sensors 141 through 147. Use of only one signal line for detecting the temperature of a TG facilitates the wiring work of the FFC.

Signals output from the respective temperature sensors are considered to be selectively extracted every time one page is printed, every head cleaning operation, or when a high print duty has continued for a predetermined period of time.

Figure 12:
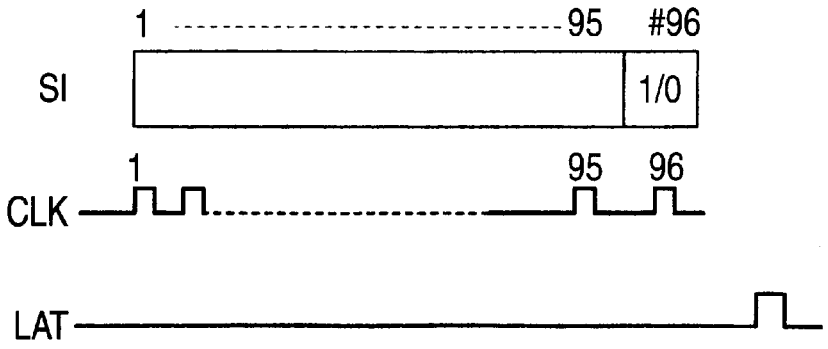
FIG. 12 is a timing chart showing a modified example of the first embodiment in which print data, a clock signal, and a latch signal, which are supplied to the shift register in the head drive circuit and to the latch circuit when a final bit of print data (96 bits) is used as identifying information to be used for selectively detecting a signal output from a temperature sensor of a TG of interest at the time of non-print operation.

As a modified example of the first embodiment shown in FIG. 12, there is also conceived a configuration in which the final bit of the print data SI (96 bits) is used as identifying information for selectively detecting a signal output from a temperature sensor of a TG of interest.

In the first embodiment, 96 bits of the print data SI corresponding to the number of nozzles (96 nozzles) are used as print data without modifications. The signal "1" or "0" for selecting one from temperature detection outputs from the TGs 138*a* through 138*g* is added to the print data SI as the #97 data. In the modification, as shown in FIG. 12, the signal "1" or "0" for selecting one from temperature detection outputs from the TGs 138*a* through 138*g* is added to the final bit of the print data SI (96 bits) corresponding to the number of nozzles (96). In this case, the identifying information belonging to the final bit must be utilized only when a 96th nozzle is in a non-print state. To this end, timing control is required. A selector is also considered to be used for switching a 96th signal to an ordinary analog switch (see 138*a*96 shown in FIG. 8) and an analog switch for temperature sensor (see 138*a*97 shown in FIG. 8; that is, an analog switch connected to the temperature sensor 141).

A printer according to a second embodiment of the present invention will now be described.

The essential configuration of the printer according to the second embodiment is substantially identical with that of the printer according to the first embodiment shown in FIGS. 1 through 4, and hence its detailed explanation is omitted.

In the first embodiment, one is selected from the outputs from the temperature sensors 141 through 147 assigned to the respective TGs, by way of the analog switches 141*a* through 147*a*. The present embodiment is characterized in that outputs of the temperature sensors are connected to a common line outside the switching circuits by way of operational amplifiers and that signals output from the temperatures sensors are selectively extracted by turning on the power to the operational amplifiers.

Figure 13:
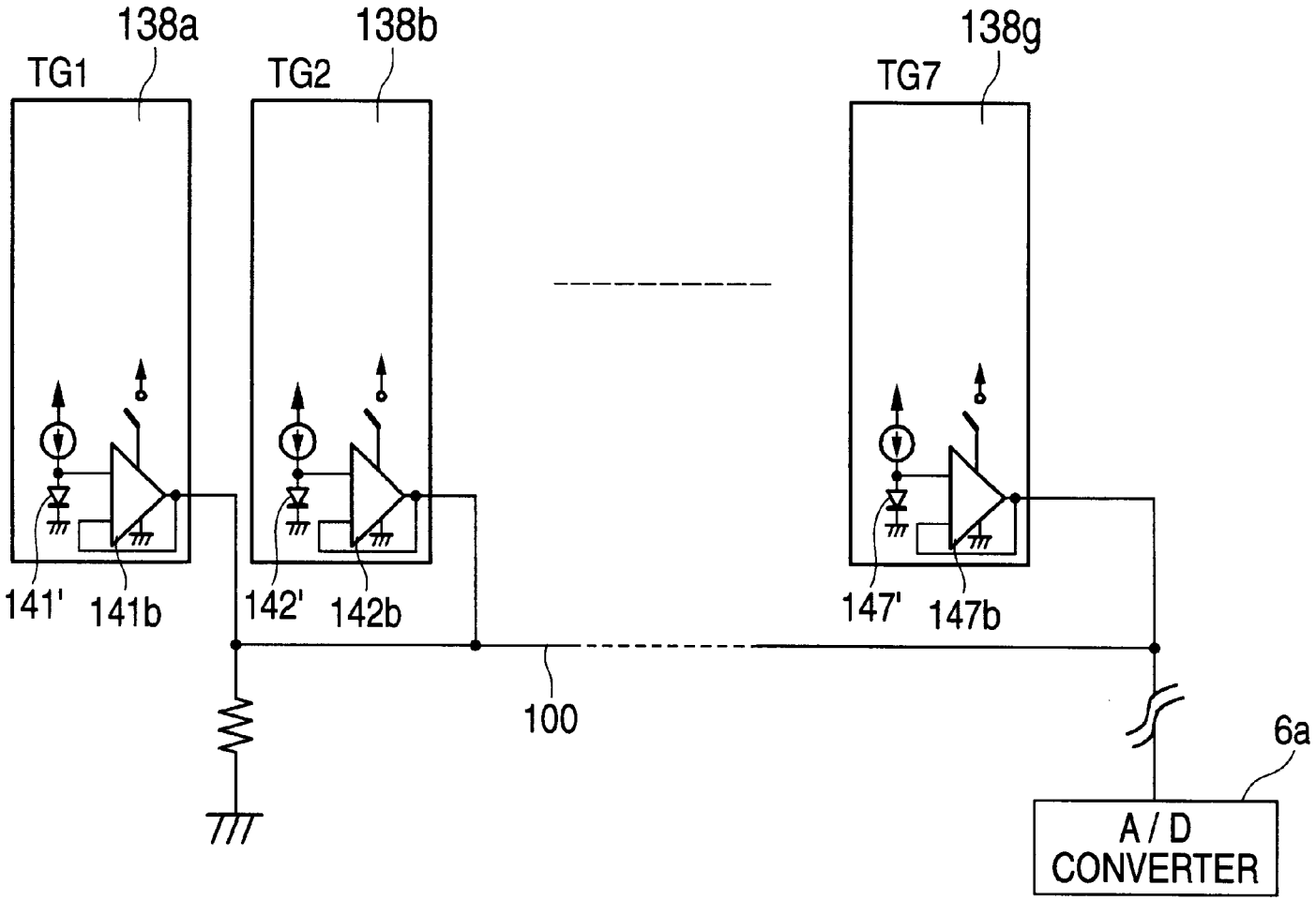
FIG. 13 is an illustration showing an example in which, according to a second embodiment, analog signals output from respective temperature sensors are connected together commonly outside IC chips including TGs by way of analog switches, and input to an A/D converter provided in a CPU of a control section by way of an FFC.

As shown in FIG. 13, output terminals 141' to 147' provided in the respective TGs 138*a* through 138*g* are connected to a common line outside the IC chips including the respective TGs. By way of the FFC 100, analog signals output from the temperature sensors 141' through 147' are input to the A/D converter 6*a* provided in the CPU 6A of the control section 6.

Figure 14:
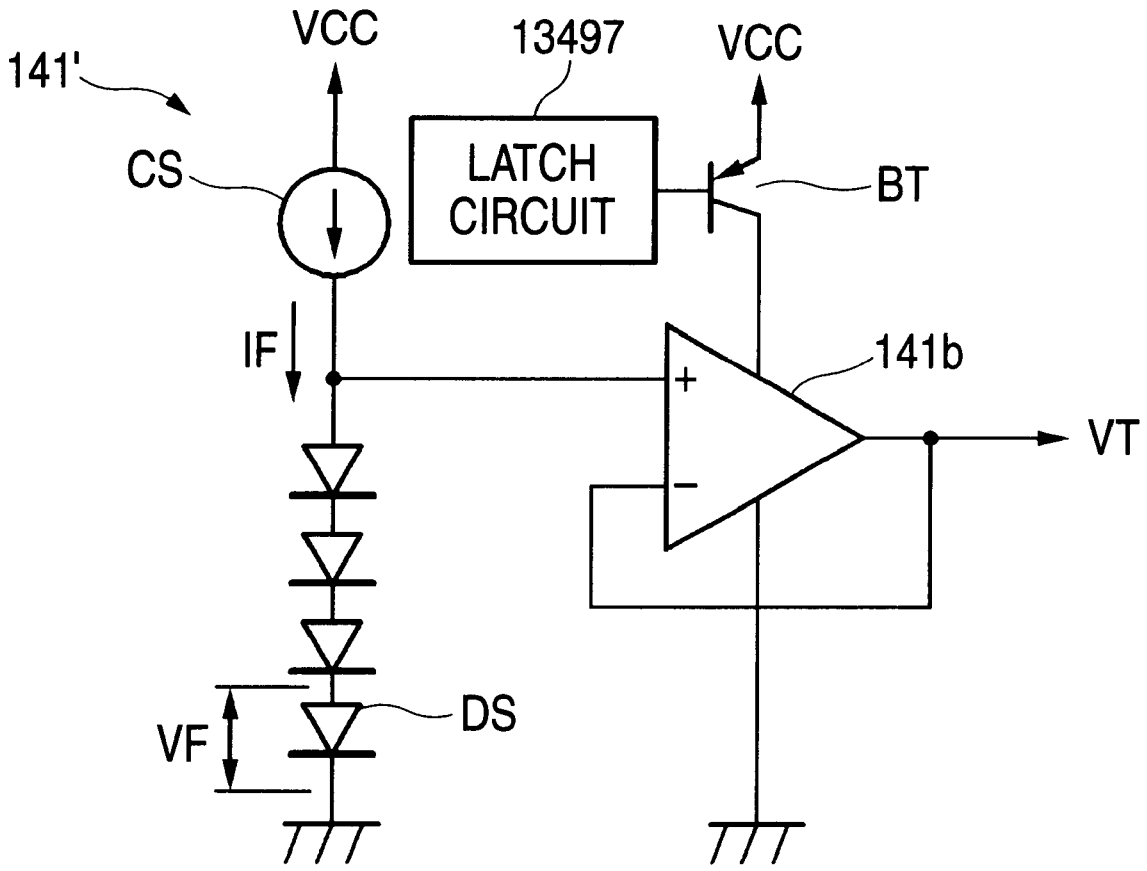
FIG. 14 is a schematic diagram showing a temperature sensor according to the second embodiment.
Figure 15:
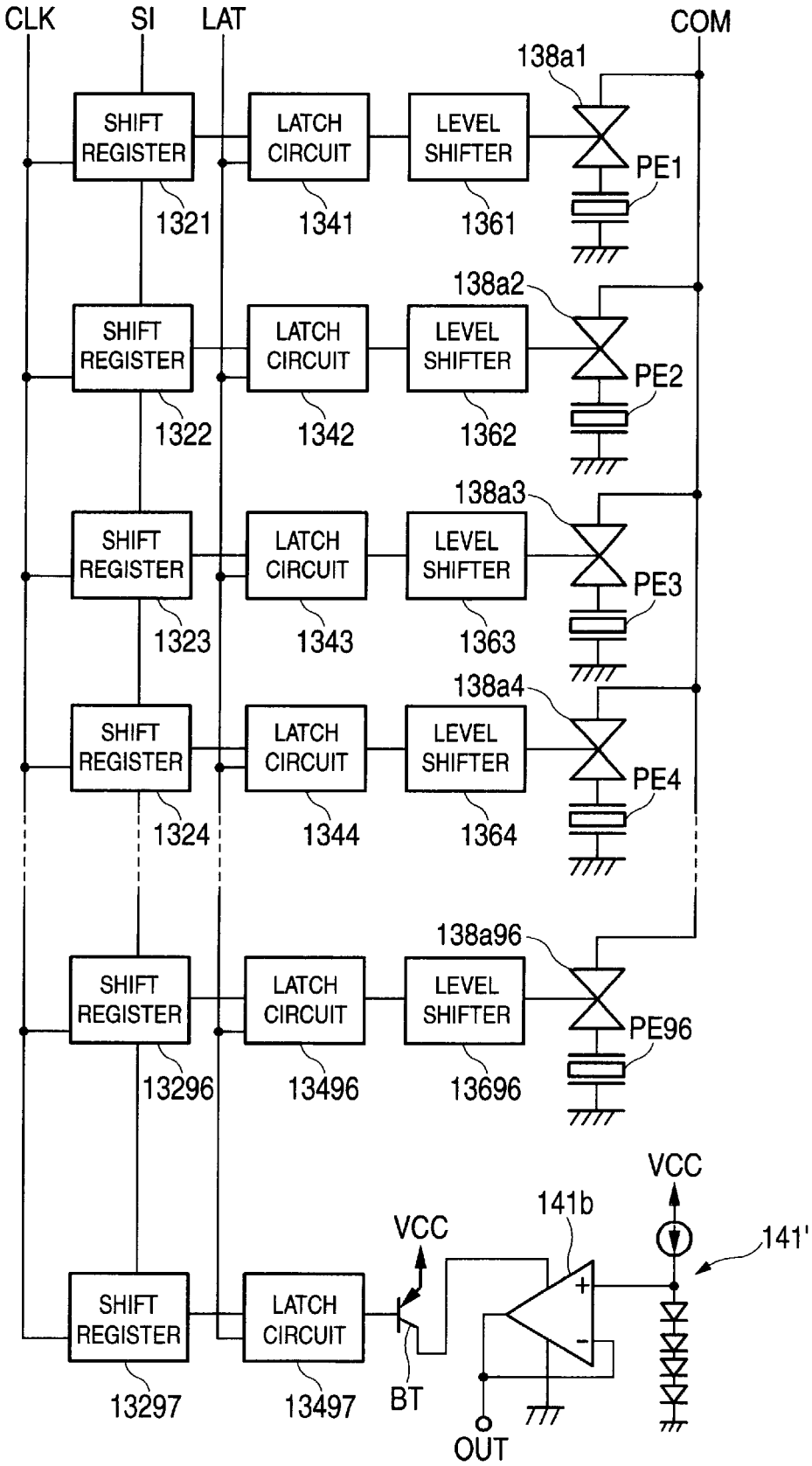
FIG. 15 is an illustration showing the configuration of a head drive circuit according to the second embodiment.

FIG. 14 is a schematic block diagram of only one (the temperature sensor 141') of the temperature sensors 141' through 147' according to the present embodiment. FIG. 15 shows the configuration of a head drive circuit according to the second embodiment. As shown in FIG. 14, the temperature sensor 14' comprises four diodes DS connected in series; a constant-current source CS supplying a forward current IF to the four diodes DS; and an operational amplifier 141*b* whose non-reversal input terminal is connected to a junction between the diodes DS and the constant current source CS. DC current is supplied from the VCC to the positive power terminal of the operational amplifier 141*b* by way of the bipolar transistor BT. As shown in FIG. 15, a latch circuit 13497 is connected to the base terminal of the bipolar transistor BT, and the bipolar transistor is activated/deactivated in accordance with a latch signal.

In the present embodiment, outputs from the temperature sensors 141' through 147' are selectively extracted by turning on/off the power to the operational amplifiers 141*b* to 147*b*.

The first and second embodiments have been described by reference to an example in which binary data as to whether or not to create a dot are transferred to the print head for each color. As a matter of course, the present invention can be applied to an example in which multi-level data are transferred to the print head, as another embodiment.

Figure 16:
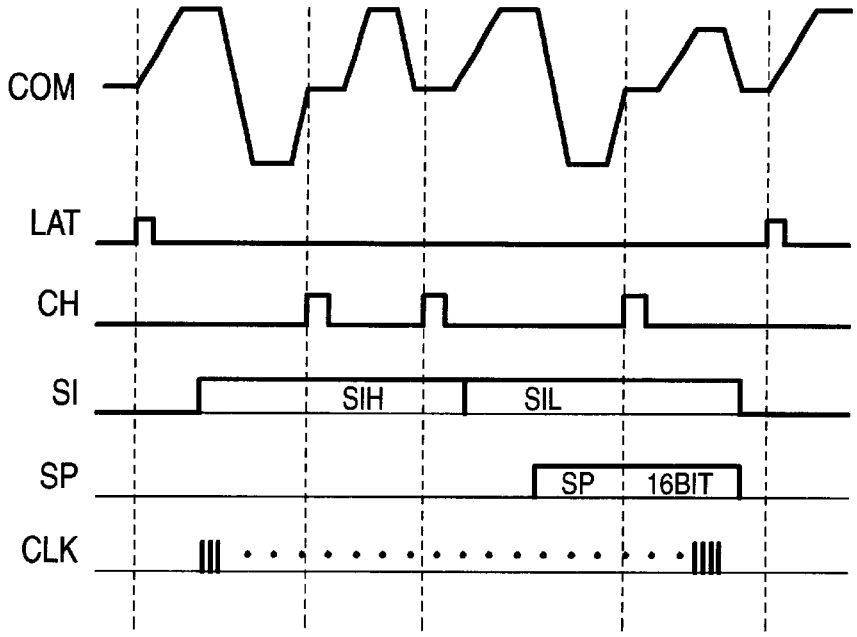
FIG. 16 is a timing chart showing program data in association with a drive signal.

As described in, e.g., Japanese Patent Publication No. 10-81013A, the present invention can be applied also to a case where dots are created at four gradation levels. In this case, as described in Japanese Patent Publication No. 10-81013A, a combination of a gradation value and a drive pulse can be set freely, by inputting program data pertaining to a truth table to a combinational circuit. At this time, 16 bits of program data are considered to be transferred every time binary print data are transferred. FIG. 16 is a timing chart, showing the program data as SP in conjunction with a drive signal. As illustrated, 16 bits of program data SP are serially transferred in synchronism with the clock signal CLK used for transferring the print data SI. The program data SP are then determined by the latch signal LAT and remain stable over a period until the next latch signal LAT. Accordingly, the program data SP can be used for selecting any one from the analog signals output from the temperature sensors 141 through 147. As in the case with use of the print data SI, one bit of data is assigned to activation/deactivation of the analog switches (TGs) of the temperature detection circuits 141 through 147.

There will now be described, as a third embodiment of the present invention, another application in which multi-level data are transferred to a print head; e.g., a method of transferring two-bit multi-level data to a 7-row head, each row having 96 nozzles.

As a premise, there will first be described a relevant method of transferring two-bit multi-level data to a 7-row head, each row having 96 nozzles.

Figure 17:
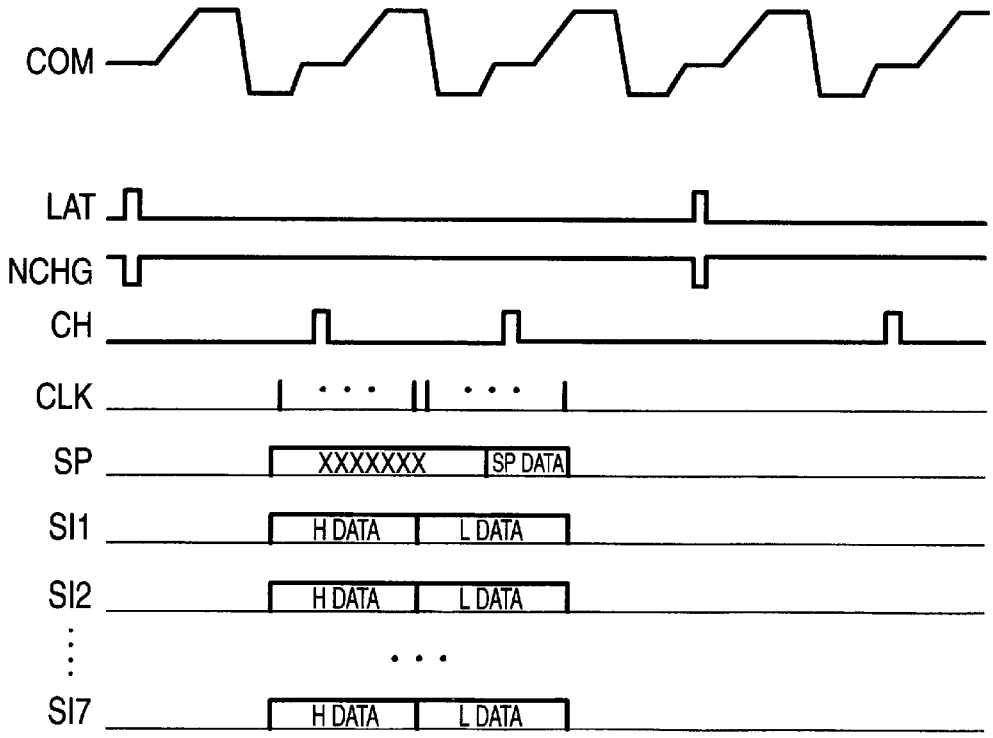
FIG. 17 is an illustration showing a related method for transferring two-bit multi-level data to a 7-row head, each row having 96 nozzles.

As shown in FIG. 17, multi-level data are transferred for a row of nozzles of each color (for each of the print data sets SI1 through SI7): 96 higher order bits (H DATA) first and 96 lower order bits (L DATA) subsequently, at 192-(96 by 2)-clock intervals. According to the method, the print data sets SI1 through SI7 are transferred to each of the TGs provided in the 7-row head. In contrast, single program data SP are transferred to the seven TGs (in other words, multi-level patterns become identical regardless of which colors of ink are selected from ink of seven colors).

Figures 18, 19:
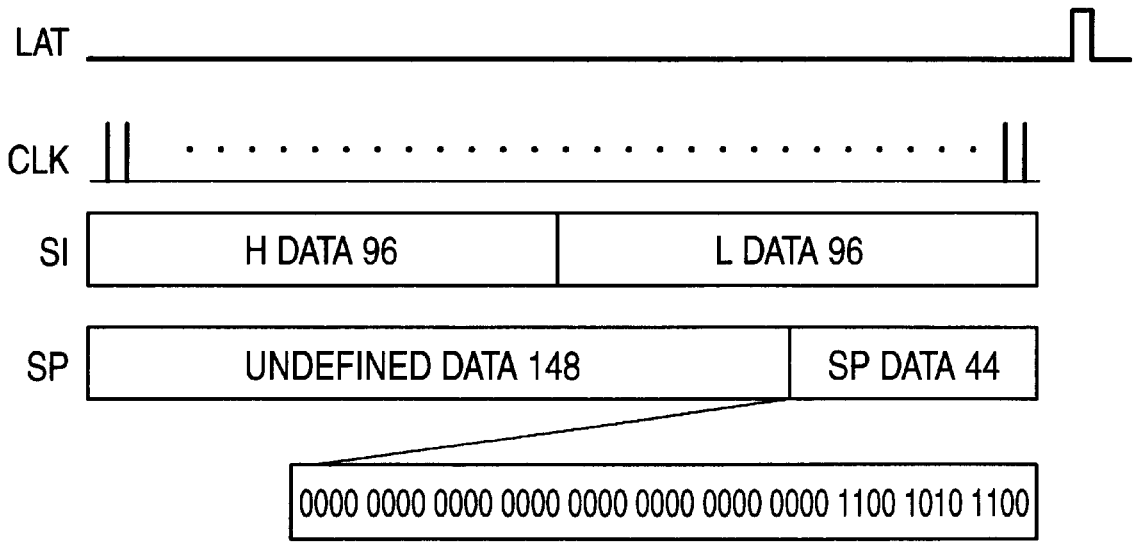
FIG. 18 is a diagram showing program data corresponding to a truth table input into the combination circuit shown in FIG. 17.
FIG. 19 is a diagram showing a method of transferring the program data according to the method shown in FIG. 17.

FIG. 18 shows program data corresponding to a truth table which is to be input to a combinational circuit according to the method, as in the case of Japanese Patent Publication No. 10-81013A. FIG. 19 shows a method of transferring the program data.

As shown in FIGS. 18 and 19, the program data SP are transferred in synchronism with the 192-clock (CLK) intervals used for transferring the SI data. As shown in FIG. 18, the method requires use of 44 (11 by 4) program data sets SP. Hence, as shown in FIG. 19, the remaining 148 data sets in parallel with the SI data sets become undefined.

Figure 20:
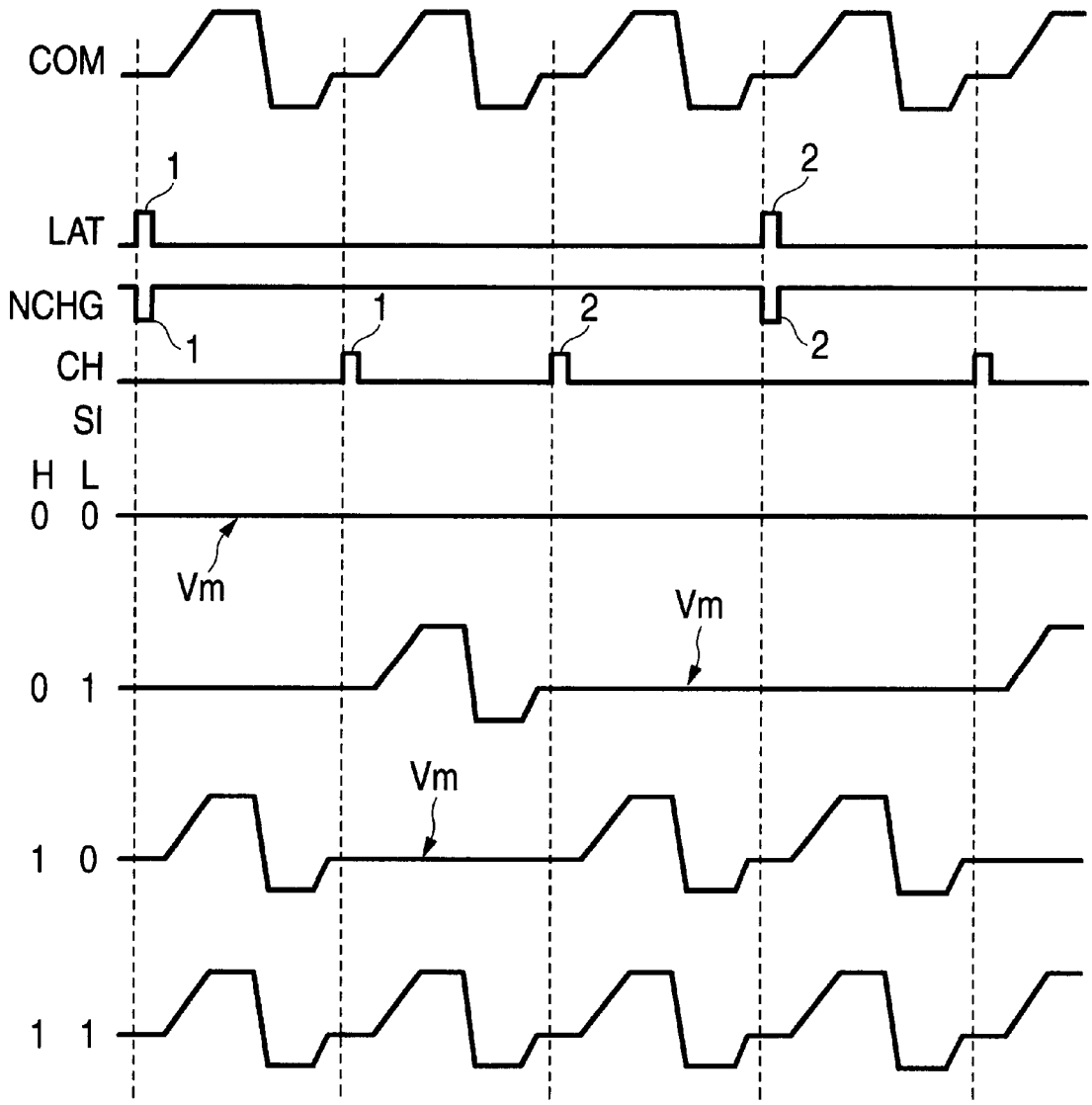
FIG. 20 is a diagram showing a correspondence between the two-bit multi-level data employed in the method shown in FIG. 17 and the waveform of an output delivered to a piezoelectric element.

FIG. 20 shows a correspondence between the two-bit multi-level data employed in the above-described method and waveforms output to the piezoelectric elements PE (PZT).

As shown in FIG. 20, when both (H DATA) and (L DATA) of the print data SI assume a value of 0, a PZT voltage is maintained at an intermediate voltage Vm during a duration between LAT1 and LAT2. Subsequently, as a result of input of a signal CH1, the PZT voltage is subjected to voltage variations corresponding to the waveform of the COM signal. As a result of input of a signal CH2, the PZT voltage is again switched to and maintained at the intermediate voltage Vm. When (H DATA) of the print data SI assume a value of 1 and (L DATA) of the same assume a value of 0, the PZT voltage is subjected to voltage variations corresponding to the waveform of the COM signal after input of an NCHG1 signal. As a result of input of the CH1 signal, the PZT voltage is again switched to and maintained at the intermediate voltage Vm. As a result of input of the signal CH2, the PZT voltage is again subjected to the voltage variations corresponding to the waveform of the COM signal. When both (H DATA) and (L DATA) of the print data SI assume a value of 1, the PZT voltage is subjected to the voltage variations corresponding to the waveform of the COM signal after input of the NCHG1 signal. Similarly, voltage variations corresponding to the waveform of the COM signal are repeated.

In order to apply the present invention to a case where the two-bit multi-level data are transferred to the 7-row head, each row having 96 nozzles, the following method can be adopted.

As shown in FIG. 19, attention has been paid to the remaining 148 data sets in parallel with the SI data being indefinite under the foregoing method. A mode data portion (one data set) is provided in front of the $_{44}$th data set of the program data SP, and the mode data portion is set to either a temperature detection mode or a print mode.

Figure 21:
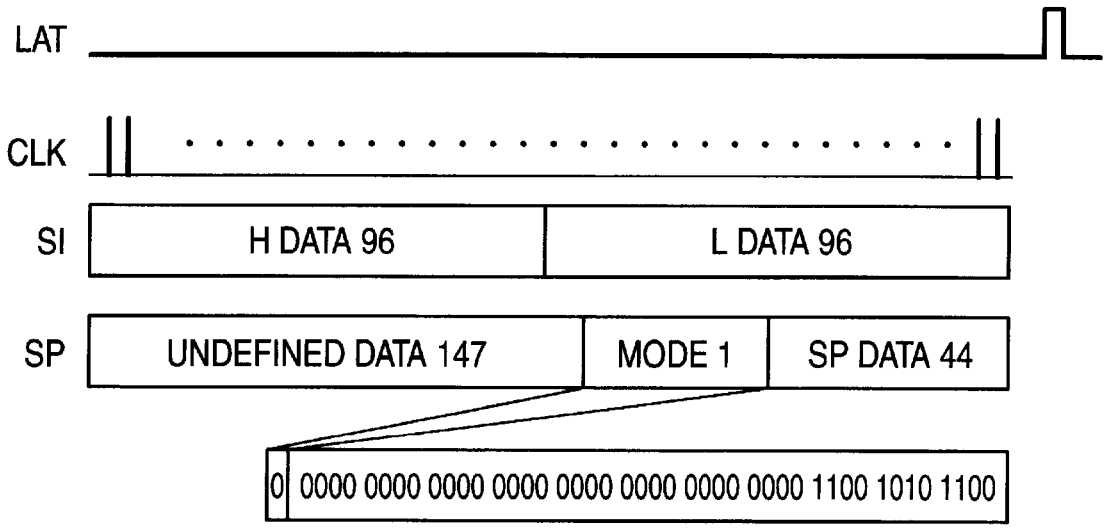
FIG. 21 is a diagram showing a method of specifying a normal print mode according to a third embodiment of the present invention.
Figure 22:
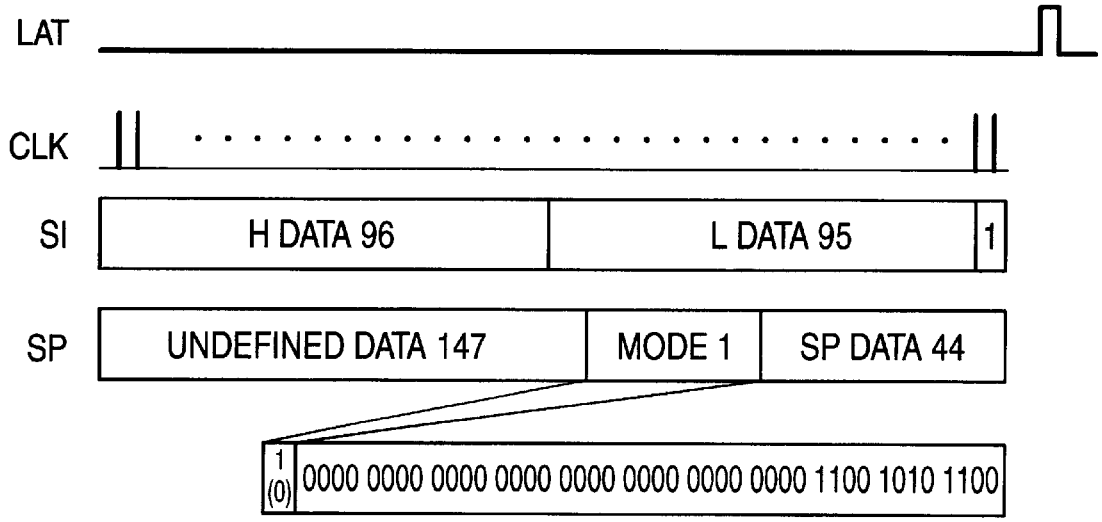
FIG. 22 is a diagram showing a method of specifying a mode for detecting a temperature of each TG according to the third embodiment.

More specifically, as shown in FIG. 21, when the mode data portion (one data set) of the program data SP assumes a value of 0, the print mode is specified as a normal print mode. As shown in FIG. 22, when the mode data portion (one data set) of the program data SP assumes a value of 1 and a lower one bit (L DATA) of an SI (any one of the SI1 through SI7) of a TG of interest assumes a value of 1, there is specified a mode for detecting the temperature of the TG of interest. When the mode data portion (one data set) of the program data SP assumes a value of 1 and a lower one bit (L DATA) of the SI (any one of the SI1 through SI7) of the TG of interest assumes a value of 0, non-detection of temperature of the TG of interest is specified. As a result, there can be obviated a necessity for use of signal lines for sensing the temperatures of respective TGs and selective extraction of any one from the analog signals output from the plurality of temperature sensors provided for the respective TGs, without involvement of an increase in the clock signal CLK.

Although the present invention has been described by reference to the specific embodiments, the present invention is not limited to these embodiments. The present invention can also be applied to other embodiments falling within the scope of the invention as defined by the appended claims.

For instance, the embodiments have stated that the temperature of a switching circuit of each row of nozzles is a detected object. The detected object is not limited to a temperature, so long as an object corresponds to information about a nozzle status. Alternatively, information is not limited to that pertaining to each row of nozzles. More specifically, as a modification of the embodiments, information about each nozzle; for example, the temperature of each nozzle or an ejecting state of each nozzle (i.e., the length of a time during which short ejecting action has been continued), may alternatively be taken as an object of detection.

Although it has been described that the signals output from the respective temperature sensors are considered to be selectively extracted every time one page is printed, every head cleaning operation, or when a high print duty has continued for a predetermined period of time, the signals may be taken at a timing other than these.

Although the previous embodiments have described that the temperature of a switching circuit assigned to each row of nozzles is detected, the temperature of a nozzle located in the vicinity of center of a nozzle row consisting of a plurality of nozzles may be detected as a typical temperature of the nozzle row.

Although a piezoelectric element has been used as a pressure generating element, a magnetostrictive element may be employed instead of the piezoelectric element. Further, the present invention can also be applied to a so-called bubble-jet ink jet printer using heat generation elements as pressure generating elements.

What is claimed is:

1. A printing apparatus, comprising:

a print head, including:

rows of plural nozzles, from which ink drops are ejected;

a plurality of driving elements respectively associated with each of said nozzles;

a plurality of switching circuits provided with a plurality of switching elements, respectively associated with each of the driving elements each of said switching elements supplies a signal to drive an associated driving element; and a plurality of detectors, each detecting a condition of associated nozzles and outputting a detecting signal in accordance with the detected condition; a controller, which drives the print head based on the detecting signals;

at least one signal line, which transmits the detecting controller in a time sequence manner, wherein the number of the at least one signal line is less than the signals to the number of the detectors.

2. The printing apparatus as set forth in claim 1, wherein:

each of the detectors detects a temperature condition of an associated switching circuit as the detected condition;

the detecting signals are transmitted via a single signal line; and the controller determines a temperature of each of the switching circuits to drive the print head based on the determined temperatures.

3. The printing apparatus as set forth in claim 2, wherein a temperature of a nozzle situated in a center of each of the nozzle rows is detected representatively as the temperature condition.

4. The printing apparatus as set forth in claim 2, wherein the detecting signals are selectively picked up and transmitted through the single signal line.

5. The printing apparatus as set forth in claim 4, wherein output sides of the respective detectors are commonly connected by an analog switch, through which the detecting signals are selectively picked up.

6. The printing apparatus as set forth in claim 4, wherein output sides of the respective detectors are commonly connected by an operational amplifier, through which the detecting signals are selectively picked up, when the operational amplifier is activated.

7. The printing apparatus as set forth in claim 4, wherein the detecting signals are selectively picked up every time one of single page printing and a print head cleaning operation is preformed.

8. The printing apparatus as set forth in claim 4, wherein the detecting signals are picked up when a high-duty printing is continued for a predetermined time period.

9. The printing apparatus as set forth in claim 4, wherein the selective pickup of the detecting signals is performed based on a signal contained in print data sent to the switching circuits.

10. The printing apparatus as set forth in claim 9, wherein the signal contained in print data comprises information on a least significant digit of the print data.

11. The printing apparatus as set forth in claim 4, wherein the selective pickup of the detecting signals is performed based on a signal contained in program data sent to the switching circuits.

12. The printing apparatus as set forth in claim 11 wherein the controller is provided with at least one analog/digital converter, each connected with an associated signal line so that the controller detects the detecting signal as a digital signal.

13. The printing apparatus as set forth in claim 12, wherein the controller is provided with a print controller of the printing apparatus.

14. The printing apparatus as set forth in claim 1, wherein each nozzle row is associated with a single color to be printed.

15. The printing apparatus as set forth in claim 2, wherein each of the detectors is provided as a temperature sensor operated in accordance with temperature dependency of a potential difference appearing between a PN junction of a semiconductor.

16. The apparatus of claim 1, wherein said plurality of said detectors comprises at least two temperature detectors, each detecting a temperature condition of an associated one of said plurality of switching circuits, and said controller determines temperatures of each of said switching circuits based on the detecting signals transmitted via a single line in a time sequence manner to drive the print head based on the determined temperatures.

17. A print controller of a print head which includes:

at least two rows of plural nozzles, from which ink drops are ejected;

a plurality of driving elements, respectively associated with each nozzle; and a plurality of switching circuits, respectively associated with each row of nozzles, each switching circuit provided with a plurality of switching elements, respectively associated with each driving elements, each switching element supplies a signal to drive an associated driving element, the print controller comprising:

a plurality of temperature detectors, each detecting temperature condition of an associated switching circuit and outputting a detecting signal in accordance with the detected temperature condition; and a controller, which determines temperature of each switching circuit based on the detecting signals transmitted via at least one signal line in a time sequence manner to drive the print head based on the determined temperatures, wherein the number of the signal line is less than the number of temperature detectors.

18. A temperature detector for a printing apparatus which includes:

at least two rows of plural nozzles, from which ink drops are ejected;

a plurality of driving elements, respectively associated with each nozzle; and a plurality of switching circuits, respectively associated with each row of nozzles, each switching circuit provided with a plurality of switching elements, respectively associated with each driving elements, each switching element supplies a signal to drive an associated driving element; and a controller, which drives the print head, the temperature detector comprising:

a plurality of temperature detectors, each detecting temperature condition of an associated switching circuit and outputting a detecting signal in accordance with the detected temperature condition;

at least one signal line for transmitting the detecting signal to the controller in a time sequence manner; and a temperature determinant provided with the controller, which determines temperature of each switching circuit based on the detecting signals to drive the print head based on the determined temperatures, wherein the number of the signal line is less than the number of temperature detectors.

19. A method of driving a print head which includes:

at least two rows of plural nozzles, from which ink drops are ejected;

a plurality of driving elements, respectively associated with each nozzle;

a plurality of switching circuits, respectively associated with each row of nozzles, each switching circuit provided with a plurality of switching elements, respectively associated with each driving elements, each switching element supplies a signal to drive an associated driving element; and a plurality of temperature detectors, each detecting temperature condition of an associated switching circuit and outputting a detecting signal in accordance with the detected temperature conditions, the method comprising the steps of:

selecting one of the detecting signals outputted form the respective temperature detectors;

picking up the selected detecting signal via at least one single signal line;

determining temperature of an associated switching circuit based on the selected detecting signal; and driving the head based on the determined temperature, wherein the number of the signal line is less than the number of temperature detectors.

20. The driving method as set forth in claim 19, wherein the selecting step and are repeated so that the detecting signals are picked up via the single signal line in a time sequence manner.

* * * * *